United States Patent [19]

Polzin

[11] Patent Number: 4,783,013

[45] Date of Patent: Nov. 8, 1988

[54] JAW CRUSHER TOGGLE BEAM LOCKING STRUCTURE

[75] Inventor: Henry H. Polzin, Brookfield, Wis.

[73] Assignee: Telsmith, Inc., Milwaukee, Wis.

[21] Appl. No.: 158,782

[22] Filed: Feb. 22, 1988

[51] Int. Cl.[4] ..... B02C 1/04

[52] U.S. Cl. ..... 241/219; 241/264; 241/286

[58] Field of Search ..... 241/219, 262, 263, 264, 241/265, 266, 267, 268, 269, 286, 287

[56] References Cited

U.S. PATENT DOCUMENTS

| | | | |
|---|---|---|---|
| 2,960,276 | 11/1960 | Roubal | 241/219 |
| 3,153,512 | 10/1964 | Polzin | 241/219 X |
| 3,166,259 | 1/1965 | Archer et al. | 241/219 |
| 3,318,540 | 5/1967 | Gilbert | 241/219 X |
| 3,473,744 | 10/1969 | De Diemar et al. | 241/219 |
| 4,165,044 | 8/1979 | Batch | 241/264 |

*Primary Examiner*—P. W. Echols

*Assistant Examiner*—Joseph M. Gorski

*Attorney, Agent, or Firm*—James E. Nilles

[57] ABSTRACT

The invention relates to a jaw crusher wherein shims behind a toggle beam define various positions of its fore-and-aft adjustment along way slots in which its end portions are guided, and wherein the toggle beam is shifted forwardly away from the shims and rearwardly towards them by a pair of hydraulic rams, each connected between the housing and an end of the toggle beam. At each end the toggle beam has a forwardly-downwardly inclined surface slidingly overlain by a wedging member that cooperates with the upper surface of the adjacent way slot to wedgingly prevent forward shifting of the toggle beam and confine it against the lower surfaces of the way slots. Each ram has link connections with the toggle beam and with a wedging member whereby the latter is pulled forward out of wedging relationship before the toggle beam is shifted forward and is pushed back to wedging condition after the toggle beam engages the shims.

9 Claims, 3 Drawing Sheets

JAW CRUSHER TOGGLE BEAM LOCKING STRUCTURE

FIELD OF THE INVENTION

This invention relates generally to jaw crushers wherein a movable jaw that cooperates with a stationary jaw is rockably fulcrumed on a toggle plate which is in turn fulcrumed on a toggle beam that is adjustable in opposite directions towards and from the stationary jaw; and the invention is more particularly concerned with improved means in such a crusher for adjustingly shifting the toggle beam in said directions and for releasably locking it against shifting and rocking in any selected position of such adjustment.

BACKGROUND OF THE INVENTION

A jaw crusher of the general type to which this invention relates is disclosed in U.S. Pat. No. 3,166,259 to Archer et al, issued in 1965 and assigned to the assignee of this application. Such a crusher has a housing comprising upright side walls to which an upright stationary jaw is fixed at the front of the housing and between which a movable jaw is swingable towards and from the stationary jaw. The movable jaw is suspended at its upper end from a power driven eccentric shaft, while its lower end is rockably pivoted against a front edge of a toggle plate that has an opposite rear edge pivoted against a shiftable but normally fixed toggle beam. Biasing means react between the toggle beam and the lower portion of the movable jaw to urge them strongly towards one another and thus confine the toggle plate between them.

For adjustment of the movable jaw that varies the fineness of the product, each of the housing side walls has a way slot that is elongated in more or less horizontal forward and rearward directions, towards and from the stationary jaw; and the toggle beam, which extends across the housing, has opposite end portions slidably received in these way slots. At each side of the housing a hydraulic ram is connected between the housing and an end portion of the toggle beam for shifting the toggle beam along the way slots. Selected positions of the toggle beam are defined by shims which are inserted in the way slots behind the toggle beam and which transfer to the housing the rearward forces imposed upon the toggle beam. The toggle beam tends to remain engaged against the shims because the movable jaw is disposed at a downward and forward inclination such that its mass tends to swing it rearwardly about the eccentric shaft from which it is suspended. However, the toggle beam should be releasably locked against shifting forwardly away from the shims under the driving forces that the eccentric shaft imposes upon it through the movable jaw. It is also important that the toggle beam be releasably locked against vertical movement because, to provide clearance for its sliding, its heightwise thickness is somewhat less than the distance between the upper and lower surfaces of each way slot.

As disclosed by Archer et al, the toggle beam is releasably confined against shifting forwardly away from the shims by means of bolts which extend forwardly through a rear part of the housing and are threaded into the toggle beam. Other bolts extend downwardly through fore-and-aft elongated slots in the housing and are threaded into the toggle beam to releasably clamp it against the upper edges of the way slots.

While commercially successful, the arrangement disclosed by Archer et al had the important disadvantage that the weight of the toggle beam subjected the downwardly extending bolts to high tension forces which tended to elongate them, and they therefore had to be tightened from time to time to maintain the toggle beam firmly clamped to the housing and thus confined against rocking.

U.S. Pat. No. 3,473,744, to DeDiemar et al, issued in 1969 and also assigned to the assignee of this application, points out that substantial manual work is required for loosening and retightening the several clamping bolts for every readjustment of the position of the toggle beam. In addition to the horizontally extending hydraulic rams which effect shifting of the toggle beam, DeDiemar et al disclose a pair of upright hydraulic rams that are employed to release the toggle beam for shifting by the horizontal rams. The upright hydraulic rams cooperate with downwardly extending clamping bolts that are threaded into the toggle beam and are biased upwardly to their clamped conditions by means of a stack of Belleville washers surrounding each bolt and reacting between its head and the housing. Extension of the upright rams forces the clamping bolts downward against the biasing force of the Belleville washers, thus freeing the toggle beam from its clamped engagement against the upper edges of the way slots. While the arrangement disclosed by DeDiemar et al eliminated the need for laborious manipulation of the several upright clamping bolts, it achieved this advantage at the cost of two additional hydraulic rams and their control valves and the like. More important, the arrangement was found to be unsatisfactory in many applications because the Belleville washers could not exert a high enough clamping force upon the toggle beam to confine it against rocking under all conditions.

U.S. Pat. No. 4,165,044 to Batch, issue in 1979 and assigned to the assignee of this application, discloses an arrangement particularly intended for a large crusher having a large and heavy toggle beam which is difficult to lift and to move and hard to secure in place once shifted to a desired position of adjustment. In this case the toggle beam is configured to cooperate with wedges which are inserted from opposite sides of the crusher housing, between the toggle beam and the upper edge of each way slot, and which clamp the toggle beam against the lower edges of the way slots. Belleville washers and hydraulic rams are arranged to cooperate in driving the wedges to and from their clamped relationship with the toggle beam and the housing. With this arrangement the toggle beam is securely confined against rocking, but the hydraulic rams employed for adjustable shifting of the toggle beam must again be supplemented by at least two further hydraulic rams and their related apparatus.

The industry concerned with jaw crushers is an actively competitive one. Nevertheless, the above discussed patents represent what has heretofore been the most advanced state of the art. Thus it has clearly not been obvious how to provide a simple, inexpensive and efficient arrangement whereby the toggle beam of a large jaw crusher can be releasably locked in any desired position of its adjustment and thereby confined against both shifting and rocking without the need for difficult and time-consuming manual labor and also without involving the cost and complexity of hydraulic rams additional to those employed for the actual shifting of the toggle beam along the way slots.

SUMMARY OF THE INVENTION

The general object of this invention is to provide a jaw crusher wherein the toggle beam is firmly and positively but releasably locked against both shifting and rocking in every position of its adjustment along the way slots, and wherein the same hydraulic ram means that adjustingly shifts the toggle beam along the way slots also provides for both its locking and its release, thus eliminating the need for laborious manual tightening and loosening of clamping bolts without entailing the cost of additional hydraulic rams or the like.

Another and more specific object of the invention is to provide a jaw crusher which achieves the above stated object and wherein the means for releasably locking the toggle beam against shifting and rocking comprises a wedging member which firmly clamps the toggle beam against the lower surfaces of the way slots and which is actuated to and from its wedging relationship with the toggle beam by means of the same power means that effects toggle beam shifting, the apparatus being arranged for automatic sequencing whereby the wedging member is moved out of its clamping relationship before shifting force is applied to the toggle beam and is moved back to that relationship after the toggle beam has been re-engaged with the shims.

It is also a specific object of the invention to provide toggle beam shifting and locking means which is so arranged that the toggle beam need not be lifted for either shifting or locking, so that the invention is in this respect very well suited for a very large crusher having a heavy toggle beam as well as being highly satisfactory for smaller crushers.

Thus an ultimate object of the invention is to effect significant improvements in both small and large jaw crushers whereby the cost and complexity of such machines is reduced while nevertheless allowing the movable jaw of the machine to be adjusted for varying the fineness of the crushed product with very little of the manual labor and down time heretofore required for that purpose, and whereby the toggle beam, when locked, is securely confined against rocking without the need for periodic attention to the tightening of clamping bolts or the like.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
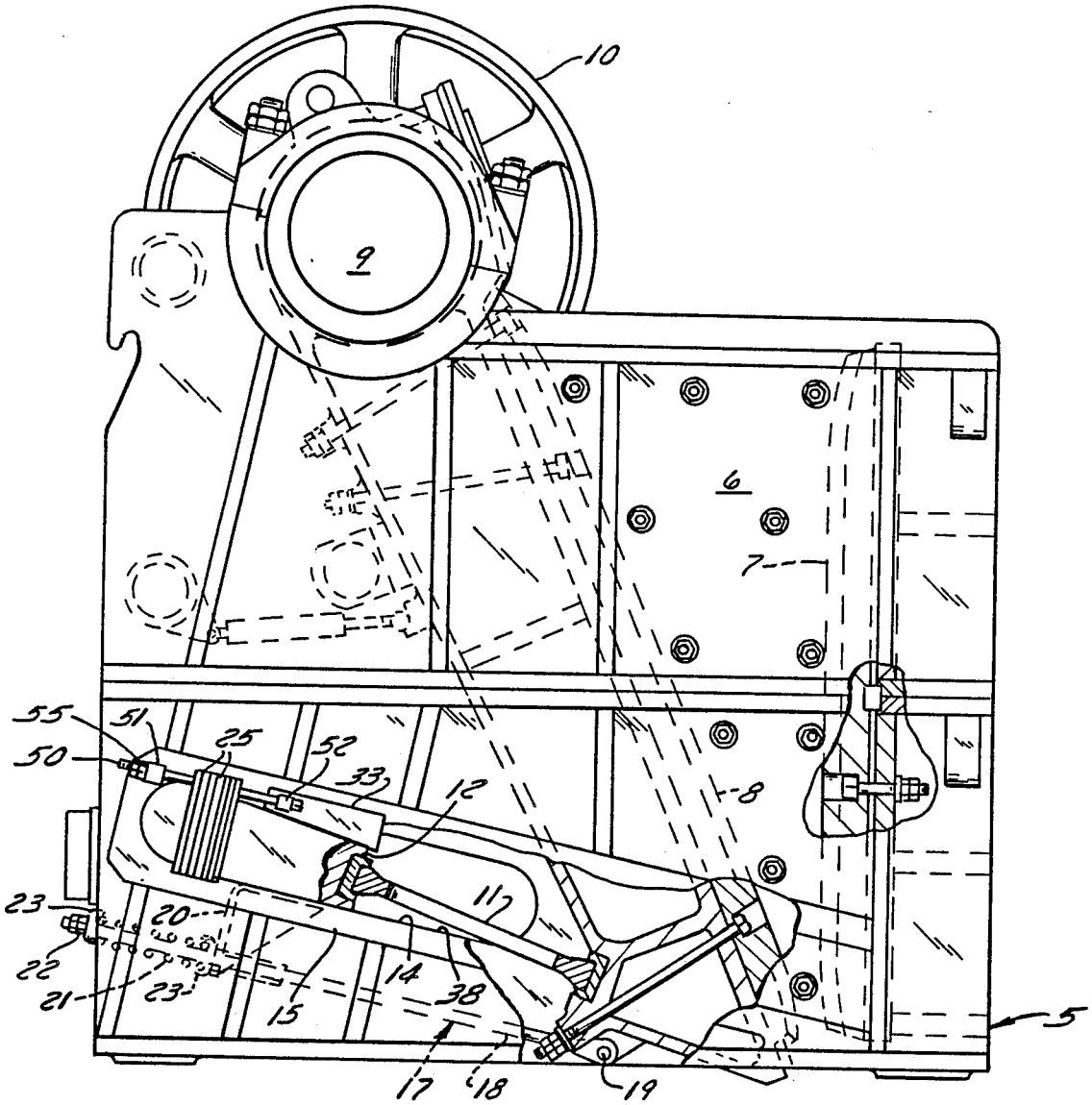
FIG. 1 is a view in side elevation, with portions shown broken away, of a jaw crusher embodying the principles of this invention.
Figure 2:
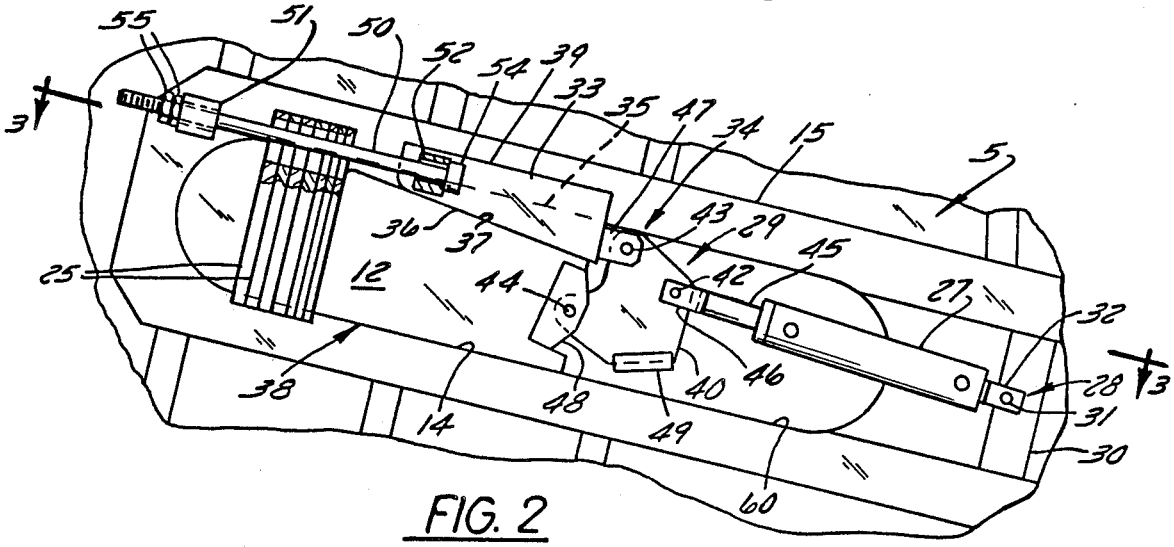
FIG. 2 is a detail view on an enlarged scale, mainly in side elevation but with portions broken away, illustrating the toggle beam shifting and locking mechanism of this invention in its locked condition.

The jaw crusher shown in the accompanying drawings comprises, in general, a main frame 5 that provides a housing having opposite upright side walls 6 and to the front of which there is fixed an upright stationary jaw member 7 that extends laterally between the side walls. Also extending between the side walls is a movable jaw member 8 which is rearwardly adjacent to the stationary jaw member 7 and cooperates with it in crushing material that is fed downwardly between the jaw members. The movable jaw member 8 is suspended at its upper end portion from an eccentric shaft 9 that is rotatably driven in a well known manner by a grooved sheave 10 connected with a suitable drive motor (not shown).

Adjacent to its lower end the movable jaw member 8 is rockably fulcrumed upon the front edge of a toggle plate 11 which extends laterally across its rear; and the toggle plate, in turn, is fulcrumed at its rear edge upon a toggle beam 12 that is normally fixed in the housing but is adjustably shiftable forward and rearward, towards and from the stationary jaw member 7. The toggle beam 12 has a length greater than the width of the housing and has its opposite end portions received in aligned way slots 14, one in each side wall 6. Each of the way slots 14 is elongated generally horizontally, and it receives the toggle beam 12 with a freely slidable fit to guide it for its adjusting motion. To each side wall 6 of the housing, at the outer side of it, there is fixed a U-shaped flange 15 that surrounds the way slot 14 and cooperates with the side wall proper in defining it.

To maintain the rockable fulcrum connections between the movable jaw member 8 and the toggle plate 11, and between the latter and the toggle beam 12, a biasing assembly 17 is connected between the toggle beam and the lower portion of the movable jaw member and reacts between them to urge them towards one another and thus maintain them in clamping relation to the toggle plate. This biasing assembly comprises a generally horizontally extending tension rod 18, the front end of which has a pivotal connection 19 to the movable jaw member, beneath the fulcrum connection between that jaw member and the toggle plate. A medial portion of the tension rod extends lengthwise slidably through a sturdy bracket 20 that is fixed to the toggle beam 12 and projects downward from it. The rear end portion of the tension rod 18, which projects a substantial distance beyond the bracket 20, is surrounded by a coiled expansion spring 21 that reacts between the bracket 20 and a lock nut 22 threaded onto the rear end of the tension rod. Washers 23 at the opposite ends of the spring 21 transfer its forces to the bracket 20 and the lock nut 22, respectively. The lock nut 22 provides for adjustment of the biasing force exerted by the spring 21 whereby the tension rod 18, and with it the lower portion of the movable jaw member, are urged relatively towards the toggle beam 12. Since the biasing assembly 17 is carried entirely by the toggle beam 12 and the movable jaw member 8, it moves with them during shifting adjustment of the toggle beam along the way slots 14 and maintains a constant biasing force in all positions of such adjustment.

The position of adjustment of the toggle beam 12 along the way slots 14—and hence the adjustment of the movable jaw member 8 relative to the stationary jaw member 7—is defined by generally conventional shims 25 which are removably inserted into each way slot 14, between the rear end of the way slot and the toggle beam, and which thus constitute adjustable forwardly facing abutments against which the end portions of the toggle beam engage. The movable jaw member 8, through its connection with the toggle beam 12, constantly imposes upon the latter a strong rearward force that tends to maintain the toggle beam engaged with the shims 25. This force exists because the movable jaw member extends at a downward and forward inclination from its connection with the eccentric shaft 9 to its fulcrum connection with the toggle plate 11, so that the movable jaw member has its center of gravity some distance forward of a vertical plane that contains the axis of the eccentric shaft and it therefore tends to swing rearward about that shaft.

A pair of substantially horizontally extending hydraulic rams 27, one at each side of the housing, provide for shifting the toggle beam 12 forwardly out of engagement with the shims 25, so that the shims can be changed, and also serve to assist gravitational force in bringing the toggle beam back into engagement with the shims. The two hydraulic rams are so connected with one another and also with a suitable control device (not shown) in a well known manner that they always operate in unison. Each of the hydraulic rams 27 has at its front end a pivotal reaction connection 28 with the housing or main frame 5 and has at its rear end a motion transmitting connection 29 with an end portion of the toggle beam 12. For the reaction connection, an upright strut 30 is fixed to the housing, bridging across the U-shaped flange 15 that surrounds each way slot 14, in forwardly spaced relation to the front end of the way slot, and this strut 30 supports a laterally extending pin 31 with which the hydraulic ram has a pivotal connection that comprises a clevis 32 fixed on the front end of the ram cylinder. The reaction connection 28 thus allows the rear end of each ram 27 to swing up and down between the upper and lower surfaces of its adjacent flange 15.

In any of the positions of adjustment at which the toggle beam 12 can be established by means of the shims 25, a pair of wedging members 33, one for each end portion of the toggle beam, releasably lock the toggle beam against forward shifting out of engagement with the shims and also firmly but releasably clamp the toggle beam against the lower surfaces of the way slots to thus confine it against rocking. As explained hereinafter, each of these wedging members 33 also has a connection 34 with the hydraulic ram 27 at its side of the housing whereby that ram moves the wedging member out of its locking relationship to the toggle beam immediately before it shifts the toggle beam forward and whereby it drives the wedging member back into such locking relationship immediately after the toggle beam has returned to engagement with the shims. Since the apparatus at each side of the housing that comprises the shims 25, the wedging member 33 and the hydraulic ram 27 and its connections 28, 29 and 34 is identical to that at the opposite side of the housing, the drawings show only one end portion of the toggle beam and its associated shifting and locking apparatus.

Each wedging member 33 has a top surface 35 that flatwise slidably opposes the upper surface of its way slot, which thus constitutes a reaction surface. The opposite bottom surface 36 of the wedging member flatwise slidably opposes an upper wedging surface 37 on its adjacent end portion of the toggle beam. The wedging member tapers rearwardly as seen from the side, since its surfaces 35 and 36 are rearwardly convergent; and thus its bottom surface 36 faces obliquely downwardly and towards the rear of the way slot. Each end portion of the toggle beam has a bottom surface 38 which flatwise slidably opposes the lower surface 60 of the way slot, and its wedging surface 37 converges forwardly towards its bottom surface. Each wedging surface 37 on the toggle beam constitutes the bottom surface of a tapering groove or slot in the top of the toggle beam, and the side surfaces of that slot guidingly confine a wedging member to forward and rearward movement relative to the toggle beam. Each wedging member 33 has a pair of flanges 39 which project above its top surface and which respectively engage the inner and outer surfaces of the side wall to confine the wedging member to forward and rearward movement relative to the housing.

The motion transmitting connections 29 and 34 of each hydraulic ram, to the toggle beam and to its wedging member respectively, comprise a plate-like toggle link 40 in which there are three laterally extending pins 42, 43, 44 that are located at the apexes of an imaginary triangle. To the pin 42, which is at the front of the toggle link, the piston rod 45 of the hydraulic ram has a pivotal connection provided by a clevis 46 fixed on its rear end. A clevis 47 fixed on the front of the wedging member 33 has a similar connection to the pin 43, which is above and behind the pin 42. In like manner a clevis 48 fixed on the front of the toggle beam connects it with the pin 44, which is spaced to the rear of the other two pins 42, 43 and below both of them.

Figure 5:
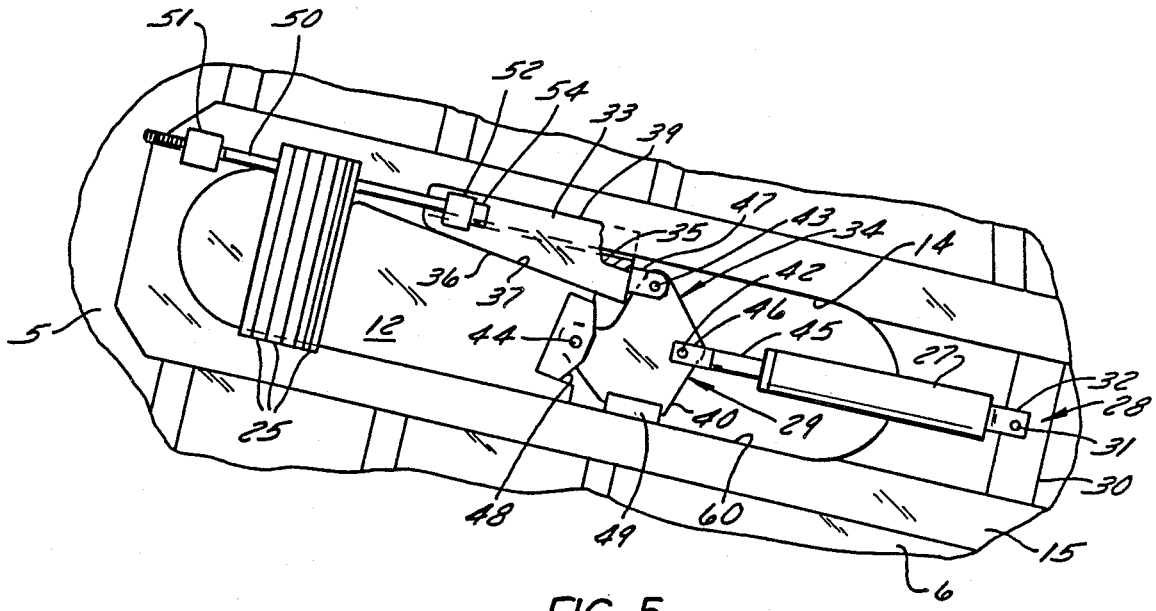
FIG. 5 is a view generally similar to FIG. 2 but showing conditions in an initial stage of a forward shift of the toggle beam and the final stage of a rearward shift of it.
Figure 6:
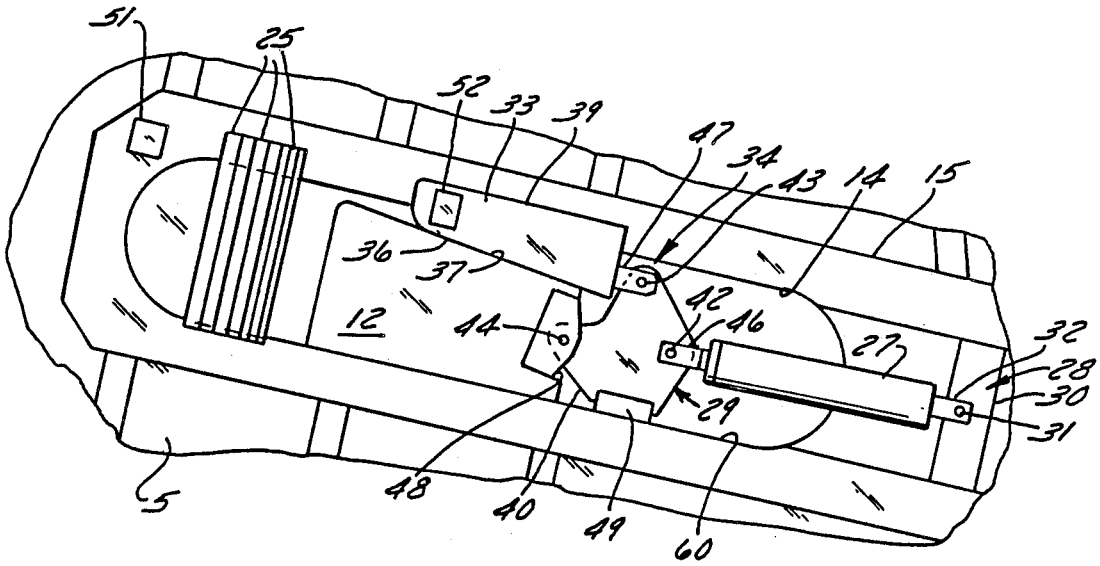
FIG. 6 is a view similar to FIG. 5 but showing conditions during the final stage of a forward shift of the toggle beam and the initial stage of a rearward shift of it.

From FIG. 5 it can be seen that as the piston rod 45 of the hydraulic ram is retracted to draw the toggle link 40 forward, the toggle link swings about the pin 44 that connects it with the toggle beam 12 and thus imposes the force of the ram upon the wedging member 33 to draw it forward and thus free the toggle beam. As the pins 42 and 44 come more nearly into alignment with the stationary pin 28 (FIG. 6) the force of the ram is applied to the toggle beam, and it is drawn forward away from engagement with the shims 25, which can then be removed or replaced to define a new position of adjustment of the toggle beam. As the ram piston extends to reestablish the toggle beam in engagement with the shims, the toggle beam is moved rearward mainly by the above described gravitational force, but with some assistance from the ram, and the toggle link 40 maintains its orientation in which the pins 42 and 44 are nearly aligned with the pin 28, but with the pin 42 slightly above a line connecting the pins 44 and 28. Hence, when the toggle beam 12 engages the shims 25, continued extension of the ram swings the toggle link upward about the pin 44 so that the extension force of the ram is applied to driving the wedging member 33 rearward into wedging relationship with the toggle beam.

To prevent the toggle link 40 from swinging too far down around the pin 44 that connects it with the toggle beam, it has a shoe 49 on its bottom that engages the lower surface 60 of the way slot and slides along that surface during forward and rearward movement of the toggle link. It will be apparent that the pin 42 that connects the hydraulic ram with the toggle link must be kept above the line through the pins 44 and 28 in order for the toggle link to be capable of returning the wedging member to its wedging condition.

Figure 3:
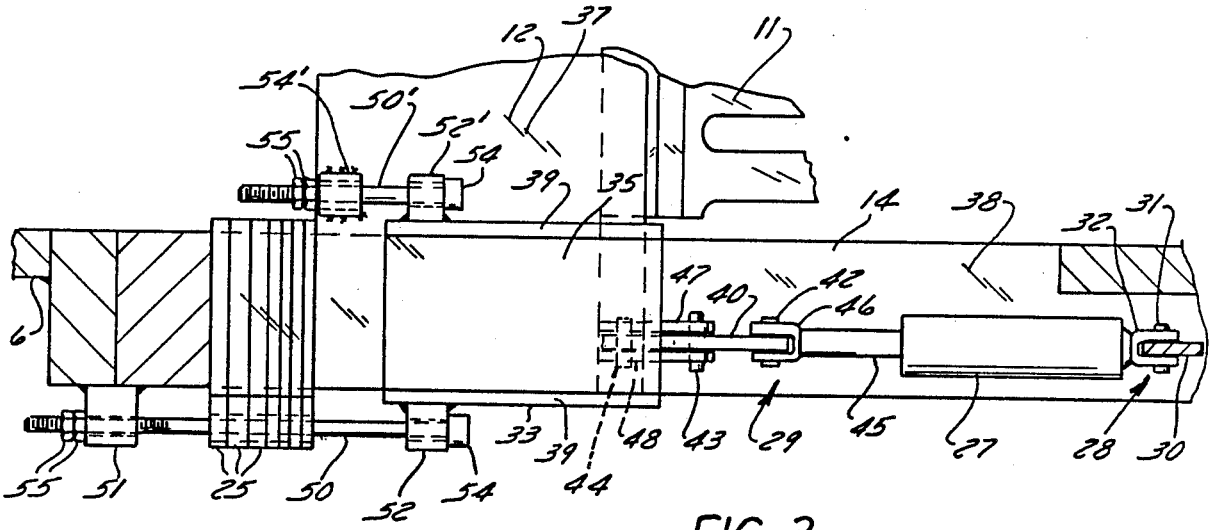
FIG. 3 is a view in horizontal section taken on the place of the line 3—3 in FIG. 2.
Figure 4:
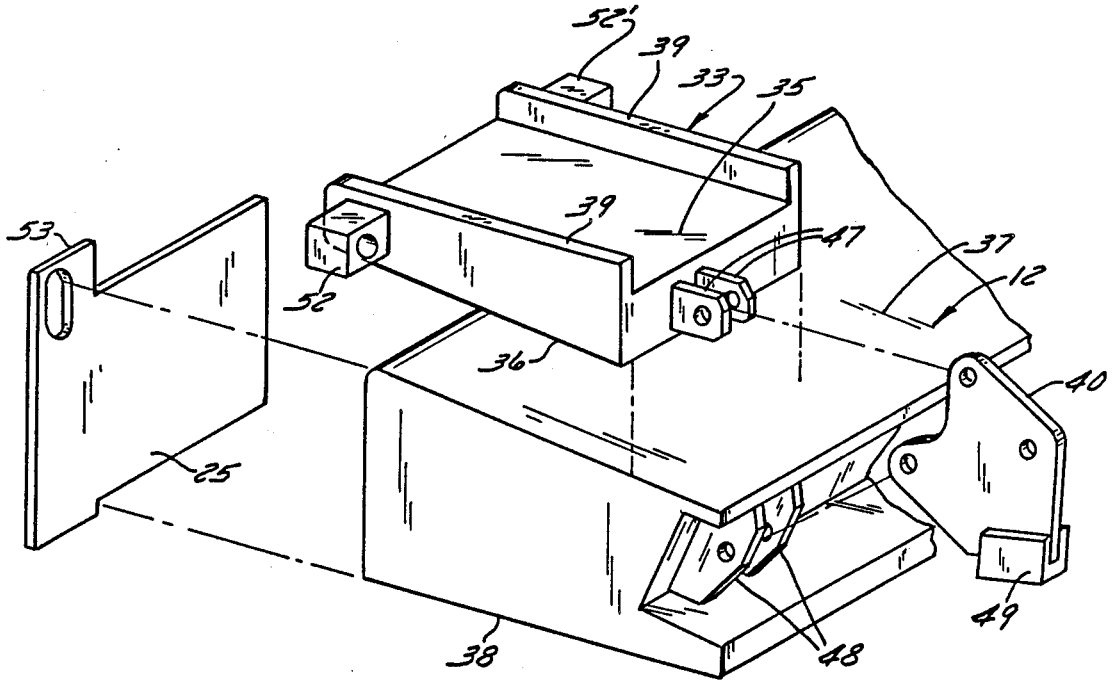
FIG. 4 is a disassembled perspective view of an end portion of the toggle beam, its associated wedging member and link member and one of the shims that cooperates with it.

As best seen in FIG. 3, a pair of substantially horizontally extending retainer bolts 50, 50', overlying opposite surfaces of each housing side wall 6, lock each wedging member 33 in its wedging condition. The retainer bolt 50 for each side wall is received in a laterally outwardly projecting retainer block 51 that is fixed on the side wall rearwardly adjacent to the rear end of its way slot, and is also received in a laterally outwardly projecting retainer block 52 fixed on the wedging member 33. This bolt 50 also extends through a hole 53 in each shim 25, in a portion of the shim that projects outwardly from the way slot, to confine the shim against displacement out of the way slot. The other retainer bolt 50' at each side wall extends through an upwardly projecting retainer block 54 that is fixed on the toggle beam, behind the wedging member, and a laterally inwardly projecting retainer block 52' on the wedging member. Heads 54 on the front ends of the retainer bolts 50, 50' engage the front retainer blocks 52, 52' and cooperate with nuts 55 on their rear ends that engage the respective retainer blocks 51, 54.

Since no substantially high forces are exerted on the retainer bolts 50, they can be quickly and easily removed and replaced for shifting adjustment of the toggle beam.

From the foregoing description it will be apparent that this invention provides a jaw crusher having means for firmly and positively but releasably locking the toggle beam against both shifting and rocking in every position of its adjustment along the way slots, and wherein the same hydraulic ram means that adjustingly shifts the toggle beam along the way slots serves both for locking it in any selected position of its adjustment and for releasing it so that it can be shifted to another such position.

What is claimed as the invention is:

1. A jaw crusher comprising a housing that supports a stationary jaw and has a pair of opposed upright walls between which a movable jaw is suspended and each of which defines a way slot that is elongated in directions toward and from the stationary jaw, a toggle beam extending across the housing and having opposite end portions received in said way slots and substantially confined by them to slidable shifting in said directions, a toggle plate between said toggle beam and the movable jaw for supporting the latter, a hydraulic ram having a reaction connection with the housing and a motion transmitting connection with the toggle beam for shifting the toggle beam in said directions, abutment means supported by the housing and engageable by the toggle beam for defining an adjustably variable limit of shifting thereof in one of said directions and thus providing a plurality of alternatively selectable positions of adjustment of the toggle beam, and locking means for releasably confining the toggle beam against motion in the other of said directions out of any selected one of said positions of adjustment, said jaw crusher being characterized by:

A. said toggle beam having a wedging surface thereon which
  (1) extends at an inclination relative to said directions and
  (2) faces obliquely in said other direction;

B. said locking means comprising a wedging member having substantially opposite force exerting surfaces
  (1) which converge towards one another in said one direction,
  (2) one of which opposingly engages a reaction surface on the housing that extends substantially in said directions, and
  (3) the other of which opposingly engages said wedging surface on the toggle beam so that said wedging member can cooperate with the housing to wedgingly confine the toggle beam against shifting in said other direction without substantially restraining its shifting in said one direction; and C. said motion transmitting connection comprising a link member having
  (1) a pivot connection with the hydraulic ram,
  (2) a second pivot connection with the toggle beam and
  (3) a third pivot connection with the wedging member,
  each said pivot connection providing for relative swinging of the link member about an axis which extends transversely to said directions and which is spaced from and parallel to the axis of each of the other two pivot connections.

2. The jaw crusher of claim 1 wherein said way slots are elongated in substantially horizontal directions and wherein said wedging surface on the toggle beam and said other force exerting surface on the wedging member face in opposite vertically oblique directions so that the wedging member, in its cooperation with the housing, can wedgingly confine the toggle beam against shifting vertically as well as against shifting in said other direction.

3. The jaw crusher of claim 1, further characterized by:

D. a pair of retainer blocks which are aligned with one another substantially in said directions,
  (1) one of said retainer blocks being fixed on the housing and
  (2) the other being fixed on said wedging member; and E. a screw received in said retainer blocks and cooperating with them to releasably confine the wedging member against shifting in said other direction.

4. The jaw crusher of claim 1, further characterized by:

D. retainer means fixed on said toggle beam and on said wedging member defining aligned screw-receiving apertures; and E. a screw received in said apertures and cooperating with said retainer means to releasably confine the wedging member against shifting in said other direction relative to the toggle beam.

5. A jaw crusher comprising a housing that supports a stationary jaw member at a front thereof and has opposed upright side walls each of which defines a way slot having opposed substantially horizontally extending upper and lower surfaces, a movable jaw member suspended between said walls rearwardly adjacent to the stationary jaw member, a toggle beam extending laterally across the housing behind the movable jaw member and having opposite end portions received in said way slots to be guided by their said surfaces for substantially forward and rearward slidable shifting, a toggle plate confined between said toggle beam and the movable jaw member for supporting the latter, a pair of hydraulic rams for shifting the toggle beam forward and rearward, one for each end portion of the toggle beam, each having at a rear end thereof a motion transmitting connection with its end portion of the toggle beam and having at its front end a pivotal reaction connection with the housing that defines a laterally extending axis about which the ram is swingable up and down, forwardly facing abutment means supported by the housing and engageable by the toggle beam for defining an adjustably variable limit of its rearward shifting and thus providing a plurality of alternatively selectable positions of its adjustment, and locking means for releasably confining the toggle beam against forward shifting out of engagement with said abutment means, said jaw crusher being characterized by:

A. said toggle beam having
  (1) bottom surface portions which at all times slidably flatwise engage said lower surfaces of the way slots and
  (2) a pair of inclined top surface portions, one for each way slot, each of which opposes and is spaced beneath the upper surface of its way slot and diverges forwardly therefrom;

B. said locking means comprising a pair of wedging members, one for each way slot, each having
  (1) a top surface flatwise slidably engageable with said upper surface of its way slot and
  (2) an opposite bottom surface which is forwardly divergent relative to its said top surface and is flatwise slidably engaged with one of said inclined top surface portions on the toggle beam
  so that each wedging member can cooperate with the upper surface of its way slot for wedgingly confining the toggle beam against forward shifting;

C. each said motion transmitting connection comprising a link member having
  (1) a first pivotal connection with the rear end of one of said hydraulic rams and
  (2) a second pivotal connection with an end portion of the toggle beam, said second pivotal connection being in rearwardly and downwardly spaced relation to said first pivotal connection and
  (3) the axes of said first and second pivotal connections being parallel to said laterally extending axis; and D. each said link member having a third pivotal connection with its adjacent wedging member that
  (1) is spaced above and to the rear of its first pivotal connection,
  (2) is in forwardly offset relation to its second pivotal connection and
  (3) defines an axis parallel to said axes.

6. The jaw crusher of claim 5, further characterized by:

E. means on the bottom of each said link member defining a downwardly facing slidable abutment surface transiently engageable with the lower surface of its adjacent way slot to confine the link member against swinging beyond positions in which said first pivotal connection is between a line that connects said third pivotal connection with the reaction connection and a line that connects said second pivotal connection with the reaction connection.

7. The jaw crusher of claim 5, further characaterized by:

E. a pair of retainer screws, one for each wedging member, each said retainer screw having
  (1) one end portion received in an aperture in its wedging member and
  (2) an opposite end portion received in an aligned aperture in the toggle beam,
  for releasably confining each wedging member against forward shifting out of wedging relationship with the toggle beam.

8. The jaw crusher of claim 5, further characterized by:

E. at least one pair of retainer blocks for each wedging member, of which
  (1) one is fixed on the wedging member and projects laterally in one direction therefrom and
  (2) the other is fixed on the housing, behind the toggle beam, and projects laterally in said direction from the housing; and F. a screw received in the two wedging blocks of each pair and cooperating with them to releasably confine their wedging member against forward shifting.

9. The jaw crusher of claim 8 wherein said abutment means comprises a plurality of shims for each way slot, each said shim being edgewise laterally insertable into and removable from its way slot and having a hole through which said screw extends to releasably confine the shim against edgewise shifting out of its way slot.

* * * * *